US005335284A

United States Patent [19]

Lemons

[11] Patent Number: 5,335,284

[45] Date of Patent: Aug. 2, 1994

[54] CONELESS, NO-MOVING-PARTS SPEAKER

[76] Inventor: James W. Lemons, Rte. 1 - Box 643, Lone Oak, Tex. 75453

[21] Appl. No.: 156,890

[22] Filed: Nov. 23, 1993

[51] Int. Cl.[5] ..... H04R 25/00

[52] U.S. Cl. ..... 381/152; 281/199; 281/205; 281/188

[58] Field of Search ..... 381/152, 199, 205, 188; 181/150, 153, 171, 199

[56] References Cited

U.S. PATENT DOCUMENTS

| | | | |
|---|---|---|---|
| 3,366,749 | 1/1968 | Ries | 179/115.5 |
| 3,430,007 | 2/1969 | Thielen | 179/115.5 |
| 3,524,027 | 8/1970 | Thurston et al. | 179/115.5 |
| 3,567,870 | 2/1971 | Rivera | 179/115.5 |
| 3,728,497 | 4/1973 | Komatsu | 179/181 W |
| 4,951,270 | 8/1990 | Andrews | 381/152 |

*Primary Examiner*—Curtis Kuntz
*Assistant Examiner*—Sinh Tran
*Attorney, Agent, or Firm*—Konneker Bush Hitt & Chwang

[57] ABSTRACT

A coneless, no-moving-parts dynamic speaker has its internal components firmly locked within a plastic housing structure to prevent their movement relative to the housing, and may be secured to a wall of a room. During operation of the speaker, mechanical sound energy that it creates is transmitted through the walls and ceiling of the room to provide an expanded sound generation pattern. The internal components of the speaker include a voice coil internally anchored to a wall of the housing, an annular magnet member sandwiched between and fixedly secured to first and second annular metal washer members, and a metal alignment shaft having one end closely received in the core portion of the voice coil, and an opposite, radially enlarged end press-fitted into one of the washers and forming with the side surface of the central magnet member opening a reverberation chamber which is closely adjacent the voice coil but does not physically receive the coil. In an alternate embodiment of the speaker the housing is foreshortened in a manner exposing the magnet member and the washer member into which the radially enlarged end portion of the alignment shaft is press-fitted.

4 Claims, 1 Drawing Sheet

CONELESS, NO-MOVING-PARTS SPEAKER

BACKGROUND OF THE INVENTION

The present invention generally relates to speaker apparatus and, in a preferred embodiment thereof, more particularly relates to coneless sound transducer devices of the general type shown in U.S. Pat. No. 3,366,749 to Ries; U.S. Pat. No. 3,430,007 to Thielen; U.S. Pat. No. 3,524,027 to Thurston et al; U.S. Pat. No. 3,567,870 to Rivera; and U.S. Pat. No. 3,728,497 to Komatsu.

Coneless dynamic speakers, as representatively illustrated and described in the U.S. patents listed above, are well known in the speaker art and are typically connectable to a relatively large structure, such as one of the walls in a room, and operable to use such structure as a diaphragm in place of a paper cone diaphragm disposed within the speaker housing. In response to electrical input signals transmitted to a voice coil within the speaker housing, mechanical sound energy is created within the housing and is transmitted outwardly to the wall which serves, in effect, as a greatly enlarged version of the sound cone omitted from the speaker. The use of the wall structure as a diaphragm creates within the room a substantially enlarged sound output pattern compared to the usual paper cone disposed within a speaker housing.

While coneless type dynamic speakers of this general type are well known in the audio art they typically have associated therewith various well know problems, limitations and disadvantages including mechanical complexity, relatively high fabrication and assembly costs, and sound distortion in certain frequency ranges. In view of these problems, limitations and disadvantages it is accordingly an object of the present invention to provide an improved coneless speaker of the type generally described above.

SUMMARY OF THE INVENTION

In carrying out principles of the present invention, in accordance with a preferred embodiment thereof, a coneless, no-moving-parts speaker is provided which has a specially designed internal configuration which makes the speaker easy and relatively inexpensive to assemble and also provides it with a high quality sound output.

The speaker includes a housing having first and second spaced apart, parallel exterior walls having facing interior side surfaces centered about an axis. An annular boss is formed on the interior side surface of the first exterior wall and is coaxial therewith. The boss has a first annular lip formed on an outer peripheral side portion thereof and axially projecting therefrom toward the second exterior housing wall. A second annular lip is formed on the interior side surface of the second exterior wall and axially projects toward the first exterior wall.

A voice coil is disposed within the housing and has a tubular core portion centered about the housing axis. The core portion has a first end fixedly secured to a radially central portion of the inner side surface of the first exterior wall, and a second end spaced inwardly apart from the interior side surface of the second exterior housing wall. Wiring means are connected to the voice coil, extend outwardly through the housing, and are operative to transmit electrical energy from an external source to the voice coil.

A first annular metal washer member is coaxially disposed within the housing and has a peripheral portion closely received by the first annular lip, a first side surface abutting the annular boss and being in a spaced apart, facing relationship with the interior side surface of the first exterior housing wall, a second side surface facing and being spaced inwardly apart from the interior side surface of the second exterior wall, and being aligned with the second end of the voice coil core portion, and a central circular opening outwardly circumscribing the voice coil.

The speaker also includes an annular magnet member disposed within the housing and having a first side surface coaxially and fixedly secured to the second side surface of the first washer member, a central circular opening having a diameter substantially identical with the diameter of the central circular opening in the first washer member, and a second side surface facing and inwardly spaced apart from the interior side surface of the second exterior wall.

A second annular metal washer member is disposed within the housing and has a first side surface coaxially and fixedly secured to the second side surface of the magnet member, a circular central opening, a peripheral portion closely received in the second annular lip, and a second side surface abutting the interior side surface of the second exterior wall.

A cylindrical metal alignment shaft is also disposed within the housing and has a first end portion closely received in the voice coil core portion, and a radially enlarged second end portion press-fitted into the circular opening in the second washer member. The side surface of the central opening in the magnet member forms with the alignment shaft an annular reverberation chamber extending from the second end of the voice coil core portion to the radially enlarged second end portion of the alignment shaft.

Using a mounting screw secured to an exterior well portion of the first exterior housing wall the speaker may be attached to a structural member, such as a wall of a room. Electrical sound signals transmitted to the voice coil is converted within the reverberation chamber to mechanical sound energy which is transmitted to the room through its walls and ceiling, the walls and ceiling serving to replace the usual paper transducer cone omitted from the speaker of the present invention. The speaker may also simply be rested on a horizontal support structure such as a table or desk and similarly utilize such support structure in place of a paper transducer cone. In an alternate embodiment of the speaker its housing structure is foreshortened in a manner exposing the magnet member and the second washer member.

DETAILED DESCRIPTION

Figure 1:
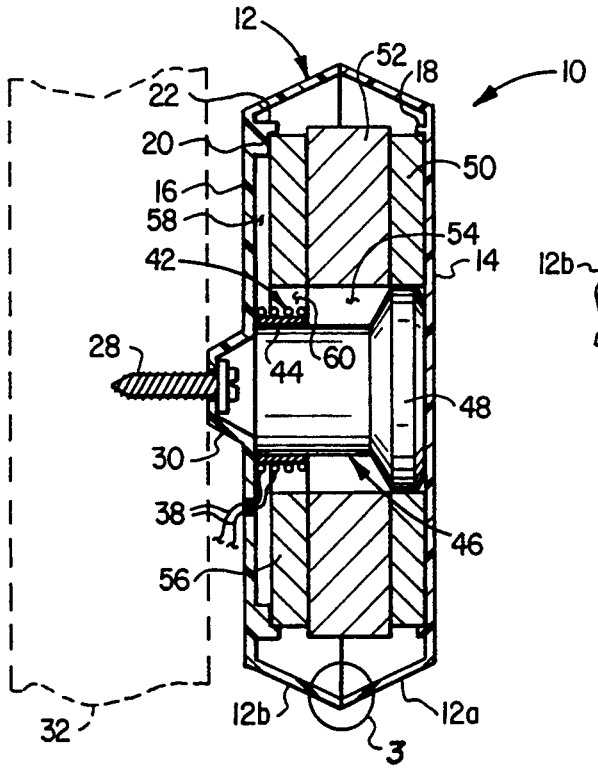
FIG. 1 is a partly elevational cross-sectional view through a coneless, no-moving-parts speaker embodying principles of the present invention.
Figure 3:
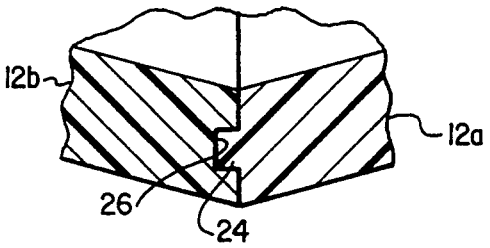
FIG. 3 is an enlarged scale cross-sectional view of the circled area "3" of the speaker housing shown in FIG. 1.

As cross-sectionally illustrated in FIG. 1, the present invention provides a coneless, no-moving-parts speaker 10 whose fixed parts are compactly disposed within a generally disc-shaped imperforate molded plastic housing 12 having intersecured front and rear side portions 12*a* and 12*b* respectively having generally circular base walls 14 and 16. Base walls 14 and 16 are spaced apart from and coaxial with one another and have facing, parallel interior side surfaces. For purposes later described, the inner side of base wall 14 has a projecting annular lip 18 formed thereon, and the inner side of base wall 16 has an annular boss 20 formed thereon. Extending around the periphery of boss 20 is an inwardly projecting annular lip 22. After the subsequently described speaker components are operatively positioned within the housing 12, the open sides of the housing portions 12*a*,12*b* are adhesively bonded together, with an annular tongue 24 formed on the inner side of the front housing portion 12*a* being received in a complementarily configured annular groove 26 formed in the inner side of the rear housing portion 12*b* as illustrated in FIG. 3.

The head of a mounting screw 28 is sealingly anchored within an external well portion 30 of the rear housing portion 12*b*, with the screw 28 projecting outwardly through the well 30 as shown. Screw 28 is used to attach the speaker 10 to an external sound transmitting structure such as the wall 32 of a room 34 schematically shown in FIG. 2.

Figure 2:
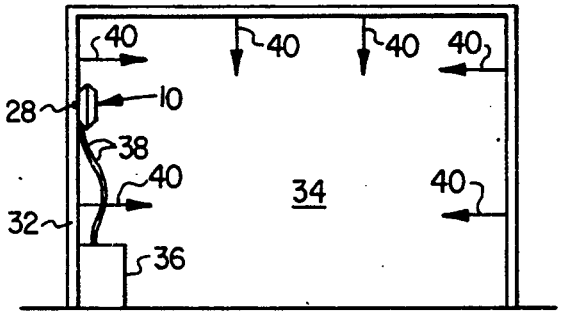
FIG. 2 is a schematic view of a representative room illustrating the sound pattern created by the speaker when it is mounted on a wall portion of the room.

In FIG. 2 the speaker 10 is representatively shown operatively connected to a stereo 36 by wires 38. The speaker 10 does not utilize the usual flexible paper cone as its sound output structure. Instead, via the screw 28, the speaker 10 directly transmits sound energy to the structure on which it is mounted, thereby causing the mounting structure to function as the omitted cone and output the speaker-generated sound. For example, as shown in FIG. 2, the single speaker 10 causes sound 40 to be generated from all the walls and the ceiling of the room 34, thereby creating for a listener the effect of being surrounded by the generated sound.

Referring again to FIG. 1, the internal speaker structure includes an ordinary hollow cylindrical, externally wound voice coil 42 (the core portion 44 of which is preferably formed from aluminum) to which the lead wires 38 are operatively connected to transmit to the coil the electrical energy output from the stereo 36. The left end of the tubular coil core 44 is epoxied centrally to the interior side surface of the base wall 16 of the rear housing side portion 12*b*, with the core 44 closely receiving a left end portion of a solid metal alignment shaft 46. As illustrated, the left end of the shaft 46 abuts the base wall 16.

A right end portion 48 of the shaft 46 is press-fitted into the interior of an annular metal front side metal washer 50. A front or right side portion of the washer 50 abuts the interior side surface of the front housing portion base wall 14 and is closely received in the annular housing lip 18 which serves to preclude radial movement of the washer 50 relative to the front housing portion 12*a*.

An annular permanent magnet member 52 is coaxially bonded to the rear side of the washer 50 and has an inner diameter substantially identical to the inner diameter of the washer 50, and an external diameter slightly larger than the external diameter of the washer 50. The interior surface of the magnet member 52 outwardly circumscribes the shaft 46 to the left of its radially enlarged portion 48 and forms therewith a generally annular reverberation chamber 54 disposed between the magnet and the shaft 54 and bounded along its right side by the radially enlarged shaft portion 48.

An annular rear side metal washer 56 is coaxially epoxied to the rear side of the magnet member 52 and has an inner diameter substantially equal to the inner diameter of the magnet member 52, an external diameter slightly less than the external diameter of the magnet member 52. A peripheral rear side portion of the washer 56 abuts the boss 20 and is closely received within the annular lip 22 which, together with the annular lip 18, serves to preclude radial movement of the intersecured magnet and washer members 50,52,56 within the housing 12. As illustrated, the rear side washer 56 forms with the rear housing base wall 16 an annular chamber 58 that circumscribes a rear end portion of the coil 42 and communicates with the reverberation chamber 54 through the annular space 60 defined between the coil 42 and the central opening in the rear side washer 56.

In constructing the speaker 10 the screw 28 and the coil 42 are operatively mounted on the rear housing side portion 12*b*. The previously formed subassembly comprising the adhesively intersecured magnet and washers, and the alignment shaft press-fitted into the front side washer, is simply slipped into place within the rear housing side portion 12*b* in a manner such that the left end of the shaft 46 passes rearwardly through the coil 42 and abuts the base wall 16, and a rear side peripheral portion of the washer 56 is closely received in the retaining boss structure 20,22.

The front housing side portion 12*a* is then secured to the rear housing side portion, as previously described, to cause the front side of the washer 50 to abut the base wall 14 and be retained within the annular lip 18. This connection of the front and rear housing side portions 12*a*,12*b* axially and radially locks the speaker components 46,50,52 and 56 within the housing.

According to a key configurational aspects of the present invention, the coil 42 is fixedly positioned relative to the balance of the speaker 10 and does not protrude forwardly into the reverberation chamber 54 within the magnet member 52. Moreover, the diameter of the reverberation chamber 54 is substantially identical to the diameter of the central opening in the washer 56, and the chamber 54 is communicated with the rear housing base wall, which serves as a diaphragm wall, via the rear annular chamber 58. This unique combination of configurational relationships within the speaker 10 has been found to provide it with improved sound output characteristics.

In response to the electrical input signals transmitted to the coil 42 via the lead wires 38, mechanical sound energy is created within the reverberation chamber 54 and is transmitted outwardly to the supporting wall structure 32 via the rear housing diaphragm wall 16 and the mounting screw 28. The wall 32, as well as the ceiling and other walls of the room 32, serve in effect as a greatly enlarged version of the sound cone omitted from the speaker 10, thereby creating the enlarged sound output pattern shown in FIG. 2.

While the mechanical coupling of the speaker 10 to the sound transmitting structure 32 is illustrated as being effected using the screw 28, other coupling methods could alternatively be used if desired. As but one example, the screw 28 could be omitted and the speaker rested on its rear side on a horizontal support surface such as a table or desk.

As can be seen from the foregoing, the speaker 10 may be quickly and easily assembled, and can be manufactured from simple, inexpensive components. Because there are no moving parts in the speaker it is also quite rugged and durable.

Figure 4:
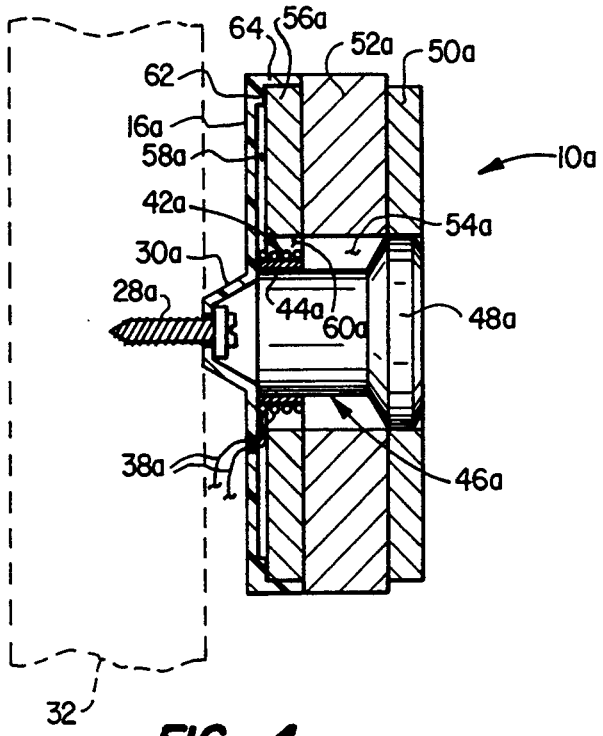
FIG. 4 is a partly elevational cross-sectional view through an alternate embodiment of the speaker.

An alternate, "open" embodiment 10*a* of the speaker 10 is cross-sectionally illustrated in FIG. 4. For ease in comparison, components in the speaker 10*a* similar to those in the speaker 10 have been given identical reference numerals having the subscripts "a". The only difference between the speakers 10 and 10*a* is in their housing structures. The housing structure for the speaker 10*a* covers only a rear side of the magnet/-washer subassembly and comprises a circular molded plastic base wall 16*a* having an outwardly projecting central well, and a forwardly projecting annular peripheral boss portion 62. Boss portion 62 has, around its outer periphery, an annular, forwardly projecting lip 64. Lip 64 has an axial length substantially identical to the thickness of the rear side washer 56*a*, and an inner diameter sized to receive the washer 56*a* in a press-fitted relationship with the lip 64.

In constructing the speaker 10*a* the screw 28*a* and the coil 42*a* are respectively secured to the well 30*a* and the inner side of the housing wall 16*a*. The washer/magnet subassembly is then secured to the housing structure by press-fitting the washer 56*a* into the annular lip 64 as illustrated in FIG. 4. As shown, this leaves the magnet member 52*a* and the front side washer 50*a* exposed. Both the interior configuration and the operation of the speaker 10*a* are identical to the interior configuration and operation of the previously described speaker 10.

The foregoing detailed description is to be clearly understood as being given by way of illustration and example only, the spirit and scope of the present invention being limited solely by the appended claims.

What is claimed is:

1. A coneless, no-moving-parts speaker comprising:

a housing having first and second spaced apart, parallel exterior walls having facing interior side surfaces;

an annular boss formed on said interior side surface of said first exterior wall;

a first annular lip formed on an outer peripheral side portion of said annular boss and axially projecting therefrom toward said second exterior wall;

a second annular lip formed on said interior side surface of said second exterior wall and axially projecting toward said first exterior wall;

a voice coil disposed on a tubular core portion within said housing, said core portion having a first end fixedly secured to a central portion of said inner side surface of said first exterior wall, and a second end spaced inwardly apart from said interior side surface of said second exterior wall;

wiring means, connected to said voice coil and extending outwardly through said housing, for transmitting electrical energy from an external source to said voice coil;

a first annular metal washer member disposed within said housing, said first metal washer member having a peripheral portion closely received by said first annular lip, a first side surface abutting said annular boss and being in a spaced apart, facing relationship with said interior side surface of said first exterior wall, a second side surface facing and being spaced inwardly apart from said interior side surface of said second exterior wall, and being aligned with said second end of said tubular core portion, and a central circular opening outwardly circumscribing said voice coil;

an annular magnet member disposed within said housing and having a first side surface coaxially and fixedly secured to said second side surface of said first washer member, a central circular opening having a diameter substantially identical with the diameter of said central circular opening of said first washer member, and a second side surface facing and inwardly spaced apart from said interior side surface of said second exterior wall;

a second annular metal washer member disposed within said housing and having a first side surface coaxially and fixedly secured to said second side surface of said magnet member, a circular central opening, a peripheral portion closely received in said second annular lip, and a second side surface abutting said interior side surface of said second exterior wall; and a cylindrical metal alignment shaft disposed within said housing and having a first end portion closely received in said tubular core portion, and a radially enlarged second end portion press-fitted into said circular opening in said second washer member, the side surface of said central opening in said magnet member forming with said alignment shaft an annular reverberation chamber extending from said second end of said tubular core portion to said radially enlarged second end portion of said alignment shaft, said alignment shaft having an end surface that abuts said interior side surface of said first exterior housing wall.

2. The coneless, no-moving-parts speaker of claim 1 wherein:

said first exterior housing wall has a central, outwardly projecting well portion, and said speaker further comprises a mounting screw member projecting outwardly through said well portion.

3. A coneless, no-moving parts speaker comprising:

a generally circular housing member centered about an axis and having a base wall with an inner side surface, an annular boss portion formed on said inner side surface, and an annular lip formed on said boss portion and axially projecting outwardly therefrom;

a voice coil disposed a tubular core portion centered about said axis, said core portion having a first and fixedly secured to a radially central portion of said inner side surface of said base wall, and a second end spaced inwardly apart from said interior side surface of said base wall;

wiring means, connected to said voice coil and extending outwardly through said housing member, for transmitting electrical energy from an external source to said voice coil;

a first annular metal washer member coaxially and fixedly received in said annular lip, a first side surface abutting said annular boss and being in a spaced apart, facing relationship with said interior side surface of said base wall, a second side surface aligned with said second end of said tubular core portion, and a central circular opening outwardly circumscribing said voice coil;

an exposed annular magnet member having a first side surface coaxially and fixedly secured to said second side surface of said first washer member, a central circular opening having a diameter substantially identical with the diameter of said central circular opening of said first washer member, and a second side surface;

an exposed second annular metal washer member having a first side surface coaxially and fixedly secured to said second side surface of said magnet member, and a circular central opening; and a cylindrical metal alignment shaft having a first end portion closely received in said tubular core portion, and a radially enlarged second end portion press-fitted into said central opening of said second washer member, a side surface of said central opening in said magnet member forming with said alignment shaft an annular reverberation chamber extending from said second end of said tubular core portion to said radially enlarged second end portion of said alignment shaft, said alignment shaft having an end surface that abuts said interior side surface of said base wall.

4. The coneless, no-moving-parts speaker of claim 3 wherein:

said base wall has a central, outwardly projecting well portion, and said speaker further comprises a mounting screw member projecting outwardly through said well portion.

* * * * *